United States Patent [19]

Goins

[11] Patent Number: 4,473,300

[45] Date of Patent: Sep. 25, 1984

[54] METHOD AND APPARATUS FOR BLENDING SOLIDS OR THE LIKE

[75] Inventor: Robert R. Goins, Bartlesville, Okla.

[73] Assignee: Phillips Petroleum Company, Bartlesville, Okla.

[21] Appl. No.: 527,541

[22] Filed: Aug. 29, 1983

[51] Int. Cl.[3] ..... B01F 5/10

[52] U.S. Cl. ..... 366/136; 366/140; 366/159; 366/181; 366/192; 366/341

[58] Field of Search ..... 366/101, 107, 136, 137, 366/140, 159, 163, 177, 178, 179, 181, 182, 189, 191, 192, 193, 341; 406/64; 414/220; 222/459

[56] References Cited

U.S. PATENT DOCUMENTS

| | | | |
|---|---|---|---|
| 2,222,380 | 11/1940 | Statler | 83/93 |
| 3,138,117 | 6/1964 | Dorey | 105/282 |
| 3,216,629 | 11/1965 | Goins | 222/459 |
| 3,275,303 | 9/1966 | Goins | 366/137 |
| 3,351,326 | 11/1967 | Alberts et al. | 366/101 |
| 3,361,413 | 1/1968 | Heyl | 366/137 |
| 3,413,039 | 11/1968 | Asgeirsson | 406/64 |
| 3,448,965 | 6/1969 | Young | 366/163 |
| 3,583,681 | 6/1971 | Brown | 366/159 |
| 3,608,869 | 9/1971 | Woodle | 366/159 |
| 3,750,478 | 8/1973 | Keene | 73/423 R |
| 4,068,828 | 1/1978 | Goins | 366/136 |
| 4,194,845 | 3/1980 | Krambrock et al. | 366/159 |
| 4,285,602 | 8/1981 | Hagerty et al. | 366/177 |
| 4,345,842 | 8/1982 | Peschl | 366/137 |

OTHER PUBLICATIONS

Brochure entitled "Valves", published by Premier Pneumatics, Inc.

*Primary Examiner*—Robert W. Jenkins
*Assistant Examiner*—Arthur D. Dahlberg
*Attorney, Agent, or Firm*—French, Hughes & Doescher

[57] ABSTRACT

Particulate materials are blended in a vessel provided with a plurality of vertically extending conduits therein. The vessel comprises a downwardly converging frustoconically shaped bottom wall which defines the lower region of the vessel. The lower ends of the conduits extend through corresponding openings in the bottom wall and are connected by suitable conduit means with a solids outlet at the open bottom of the bottom wall, an outlet conduit extending downwardly therefrom with a solids flow control valve interposed therein. A recycle conduit extends from the interior of the outlet conduit at a position above the solids flow control valve therein upwardly to a solids hopper positioned above the vessel. A blower is connected to the upper portion of the vessel and applies vacuum thereto and to the recycle conduit for withdrawing particulate materials or solids through the recycle conduit into the hopper. A hopper conduit extends from the bottom of the hopper to the interior of the upper portion of the vessel and is provided with a flow control valve interposed therein. A sample valve mechanism is interposed in the recycle conduit for withdrawing samples of the solids from within the recycle conduit. Recycle vents communicate between the interior of the recycle conduit and atmosphere via excess flow valves to provide means for facilitating the fluidizing of solids within the recycle conduit in response to the vacuum applied thereto by the blower. Methods of blending solids using the described apparatus are also disclosed.

21 Claims, 1 Drawing Figure

METHOD AND APPARATUS FOR BLENDING SOLIDS OR THE LIKE

Figure 1:
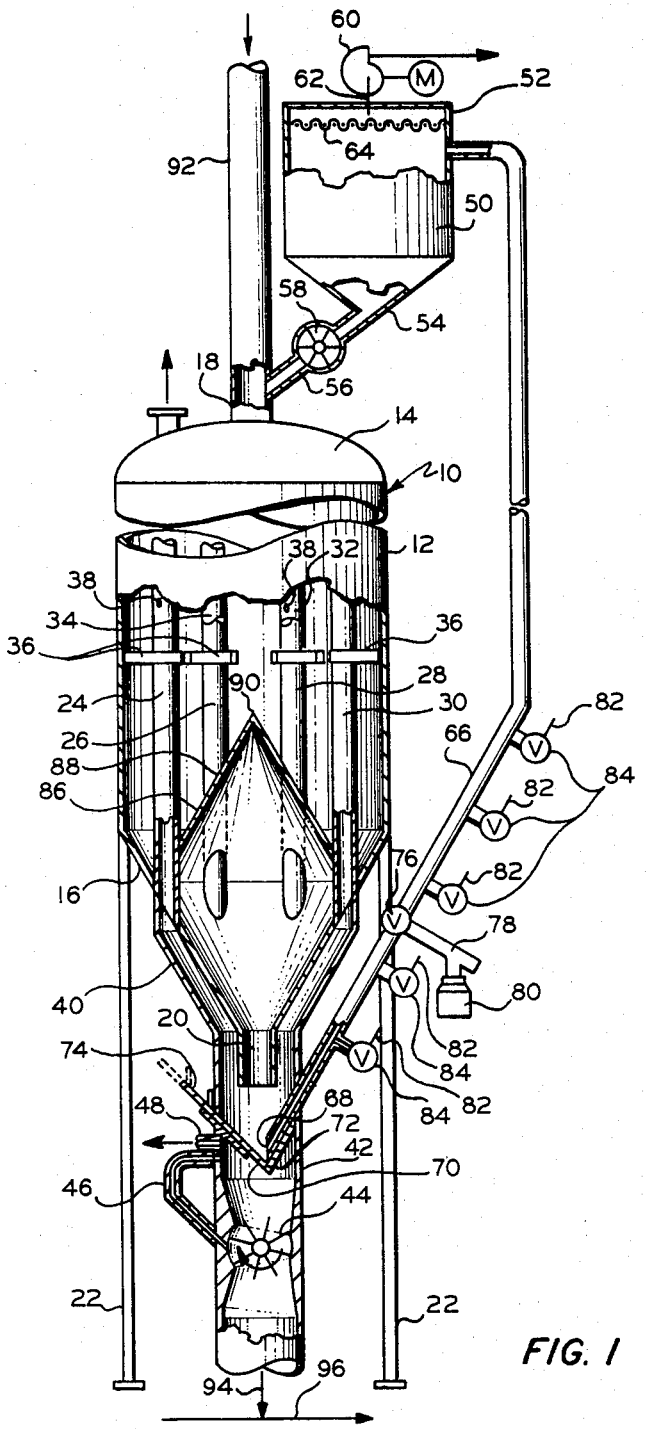

The invention relates generally to improvements in blending particulate materials or solids, and more particularly, but not by way of limitation, to improved method and apparatus for such blending of particulate materials.

It is often necessary to blend or homogenize hopper car- or truck-size batches or quantities of particulate materials or solids in order to produce uniform mixtures. In the plastics industry, for example, slight variations in properties of polymers may occur in different production runs. Blending of the pellets made in such runs is important to insure products of uniform quality. As disclosed in U.S. Pat. Nos. 3,216,629; 3,275,303; 3,456,922; and 4,068,828, efficient blending of particulate materials can be accomplished by the use of apparatus which comprises a vessel having a plurality of vertically extending conduits therein. The solids to be blended are positioned within the vessel surrounding the conduits. The conduits are provided with openings through which the particles enter the conduits to flow by gravity downwardly through the conduits to a common collection zone.

While blending apparatus of the general type disclosed in the foregoing patents has been found to be quite effective, it has been found to be desirable to obtain improved sampling and blending of particulate materials or solids from the lower region of such blending apparatus.

In accordance with the present invention, improved blender apparatus of the general type described above are provided. A preferred embodiment of the blender apparatus of the present invention employs a blender vessel having an upper region and a lower region. The lower region of the blender vessel is defined by a downwardly converging generally frustoconically shaped bottom wall. Solids outlet means communicates with the interior of the lower region of the vessel. The blender apparatus further includes conduit means communicating between at least one location in the interior of the upper region of the vessel and the solids outlet means at a first location below the bottom wall for conducting solids from the upper region of the vessel to the solids outlet means. The blender apparatus is further provided with first solids flow control means disposed in the solids outlet means at a second location below the first location for blocking flow of solids downwardly through the solids outlet means when the first solids flow control means is in a first condition, and, alternately, for allowing flow of blended solids downwardly therepast through the solids outlet means when the first solids flow control means is in a second condition. The blender apparatus is additionally provided with solids hopper means disposed above the vessel for receiving solids therein, the solids hopper means having upper and lower end portions. Hopper conduit means communicate between the lower end portion of the solids hopper means and the interior of the upper region of the vessel. Disposed in the hopper conduit means are second flow control means for blocking flow of gas and solids through the hopper conduit means when the second solids flow control means is in a first condition, and, alternately, for allowing flow of solids downwardly therepast through the hopper conduit means when the second solids flow control means is in a second condition. The blender apparatus further includes vacuum means in fluid flow communication with the interior of the upper end portion of the solids hopper means for applying a vacuum to the interior of the solids hopper means. The blender apparatus is additionally provided with solids recycle conduit means communicating between the solids outlet means, at a third location intermediate the first and second locations, and the interior of the solids hopper means for conducting solids from the solids outlet means to the interior of the solids hopper means in response to the vacuum applied to interior of the solids hopper means by the vacuum means.

It is an object of the present invention to provide improved blender apparatus for sampling and blending particulate materials or solids.

It is another object of the invention to provide an improved method of sampling and blending particulate materials or solids.

It is yet another object of the present invention to provide improved method and apparatus for blending a quantity of particulate materials or solids in a single pass of such materials or solids through the apparatus.

It is a further object of the present invention to provide method and apparatus for sampling blended particulate materials or solids during the filling of the apparatus vessel with such materials or solids.

It is still another object of the present invention to provide improved method and apparatus for sampling and blending particulate materials or solids which method and apparatus are reliable and economical in operation.

Other aspects, advantages and objects of the present invention will become readily apparent to those skilled in the art upon further study of the instant specification, claims and drawing in which the single FIGURE is a side elevation view of one embodiment of the present invention with portions thereof broken away to more clearly illustrate construction details.

Referring now to the drawing, there is illustrated therein an upright, generally cylindrical vessel 10 comprising a generally cylindrical sidewall 12, a top closure 14, and a downwardly converging, generally frustoconically shaped bottom wall or closure 16. The top closure 14 is provided with a solids inlet or filling port 18, and the bottom wall or closure 16 is provided with a solids outlet or withdrawal pipe 20 which communicates with the convergent lower end portion of the bottom wall 16. The vessel 10 can be suitably supported in a vertical position by means of a plurality of legs 22. The sidewall 12 and top closure 14 define and enclose the upper region of the vessel 10, while the bottom wall 16 defines and encloses the lower region of the vessel 10.

A plurality of conduits 24, 26, 28, 30, 32 and 34 are positioned in the upper region of the vessel 10 by means of suitable supports 36 so that the conduits are secured in generally vertical mutually parallel relation within the vessel. The upper end portion of each of the conduits is provided with at least one opening 38 therein providing communication between the interior of the conduit and the upper region of the interior of the vessel 10. The lower end portion of each of the conduits extends downwardly through the lower region of the interior of the vessel 10 and through a corresponding opening in the bottom wall 16, which opening is suitably sealingly engaged with the outer surface of the respective conduit extending therethrough. A downwardly convergent, generally frustoconically shaped conduit 40 communicates with the lower ends of the conduits 24, 26, 28, 30, 32 and 34 and terminates at its lower end in an outlet conduit 42 surrounding and extending downwardly from the exterior of the solids outlet 20, the outlet conduit 42 and the solids outlet 20 comprising solids outlet means in the solids blending apparatus. It will be understood that other forms of conduits may be employed to provide flow communication between the lower ends of the conduits 24, 26, 28, 30, 32 and 34 and the annular space between the outlet conduit 42 and the exterior of the solids outlet 20 such as, for example, individual tubular conduits each associated with a respective one of the conduits 24, 26, 28, 30, 32 and 34. The conduit 40, or equivalent structure, provides means for conveying particulate materials or solids by gravity from the interior of the vessel 10 via openings 38 and conduits 24, 26, 28, 30, 32 and 34 to the annular space between the outlet conduit 42 and the exterior of the solids outlet 20.

A solids flow control valve 44 is disposed within the lower portion of the outlet conduit 42 and provides means for blocking flow of solids downwardly through the outlet conduit 42 when the valve 44 is in a first condition, and, alternately for allowing flow of blended solids downwardly therepassed through the outlet conduit 42 when the valve 44 is in a second condition. A suitable valve for use as the solids flow control valve 44 is a rotary air lock valve which blocks the flow of solids therepast when in a non-rotating first condition, and which permits the passage of solids therethrough when the rotor is in a rotating second condition while still providing a substantial blockage to the flow of air therepast. It is presently preferred to provide the valve 44 with a vent conduit 46 providing fluid flow communication between the interior of the medial portion of the rotor housing of the valve and the interior of the outlet conduit 42 at a location upstream of the valve 44. The vent conduit 46 allows the maintenance of the valve 44 at atmospheric pressure when the blending apparatus is feeding a pressurized conveyor downstream of the control valve 44. It is also presently preferred to vent the interior of the outlet conduit 42 to the atmosphere as shown at 48 proximate the connection between the vent conduit 46 and the outlet conduit 42 upstream of the valve 44. Venting through vent conduit 46 into the outlet conduit 42 and then out through the vent 48 permits recovery in the outlet conduit 42 of any solids conveyed from the valve 44 into the vent conduit 46.

A solids hopper 50 is disposed above the vessel 10 and is characterized by an upper end portion 52 and a lower end portion 54. A hopper conduit 56 communicates between the lower end portion 54 and the interior of the upper region of the vessel 10. The connection with the interior of the upper region of the vessel 10 can be conveniently achieved by connecting the lower end of the downwardly extending hopper conduit 56 to the interior of the solids inlet 18. A solids flow control valve 58 is interposed in the hopper conduit 56 and provides means for blocking flow of gas and solids through the hopper conduit 56 when the valve 58 is in a first condition, and, alternately, for allowing flow of solids downwardly therepast through the hopper conduit 56 when the valve 58 is in a second condition. It is presently preferred to employ a rotary air lock valve as the solids flow control valve 58, although other suitable forms of valves can be employed as the solids flow control valve 58. For example, a highly effective device can be provided by employing a flapper valve as the solids flow control valve 58, such flapper valve being weight-biased or spring-biased into its first or closed condition and being adapted to be additionally biased into the closed portion by the application of a vacuum to the interior of the solids hopper 50.

A suitable motor-driven blower 60 is connected to the interior of the upper end portion of the hopper 50 by means of a suitable conduit 62 and provides means for applying a vacuum to the interior of the hopper 50. The hopper 50 is additionally provided with a suitable filter 64 for separating solids within the hopper 50 from the conduit 62 leading to the blower 60 when the blower is applying a vacuum to the interior of the hopper 50.

A recycle conduit 66 communicates between the interior of the outlet conduit 42 a at location below the solids outlet 2O and above the solids flow control valve 44 and the interior of the solids hopper 50. The recycle conduit 66 provides means for conducting solids from the interior of the outlet conduit 42 to the interior of the solids hopper 50 in response to the vacuum applied to the interior of the solids hopper 50 by means of the blower 60 and conduit 62. The lower end of the recycle conduit 66 is preferably located within the outlet conduit 42 at or near the vertical center line thereof as shown at 68. The location of the lower end of the recycle conduit 66 thus facilitates the withdrawal of a portion of the blended solids passing downwardly therepast from the solids outlet 20 and from the annular space between the outlet conduit 42 and the exterior surface of the solids outlet 2O.

It is presently preferred to provide an additional solids flow control valve mechanism 70 within the outlet conduit 42 at a location just below the lower end 68 of the recycle conduit 66 and above the vent 48 in the outlet conduit 42. The valve 70 preferably comprises a fixed inclined plate 72 which extends across and occludes a substantial portion of the horizontal cross-sectional area of the outlet conduit 42, but preferably less than one-half the horizontal cross-sectional area. It is also presently preferred that the open lower end 68 of the recycle conduit 66 is positioned as near as possible to the upper surface of the plate 72. The solids flow control valve 70 further includes an adjustable inclined plate 74 which extends across and is capable of cooperating with the plate 72 to totally occlude the horizontal cross-sectional area of the outlet conduit 42 in a first condition of the adjustable plate 74 as shown by the solid lines in the drawing. The plate 74 is adapted to be slidingly withdrawn upwardly and to the left as viewed in the drawing and as indicated by the dashed lines to vary the cross-sectional flow area between the plates 74 and 72 and thereby control the flow of solids therepassed as may be desired for proper operation of the apparatus of the present invention. If desired, the plate 72 can be an adjustable plate similar in construction to the plate 74. If both plates 72 and 74 are adjustable, the opening therebetween can be precisely positioned in the center of the outlet conduit 42.

A suitable valve 76 communicates with the recycle conduit 66 to provide means for withdrawing a sample of solids from the solids recycle conduit 66 and passing the thus withdrawn sample of solids through an interconnecting conduit 78 to a suitable sample container 80. The valve 76 is preferably adapted to withdraw such a sample when the vacuum has been withdrawn from the recycle conduit 66 and the solids within the conduit 66 have been allowed to settle in the lower portion of the conduit 66. It is within the scope of the invention to employ a valve 76 adapted to permit withdrawal of a sample of solids during the vacuum recycle of solids through the recycle conduit 66. It will be understood that the valve 76 will communicate with the recycle conduit at a location substantially below the top surface of the settled bed of solids in the lower portion of the recycle conduit 66 when the vacuum has been withdrawn from the recycle conduit 66 in order to assure the withdrawal of an adequate sample of the recycled solids.

It is further presently preferred to provide the recycle conduit 66 with one or more vents 82 each communicating between the interior of the conduit 66 and the atmosphere and spaced along the length of the lower portion of the recycle conduit 66. The vents 82 provide means for admitting air or any other suitable gas therethrough to facilitate fluidizing solids in the recycle conduit 66 in response to the application of vacuum applied to the conduit by the blower 60. The vents 82 will be especially advantageous when restarting the blower 60 after solids in the conduit 66 have been allowed to settle to the bottom thereof upon a previous withdrawal of the vacuum applied thereto. It is presently preferred to provide each vent 82 with a suitable vent valve 84 interposed therein to adjust the gas flow through the respective vents in response to the application of vacuum to the recycle conduit 66. It is presently preferred that the vent valves 84 be of the type which is generally characterized as excess flow type. The excess flow type vent valve 84 permits air or gas flow through the valve and the corresponding vent 82 in which it is interposed until the rate of such flow reaches or exceeds a predetermined threshold value. When that predetermined threshold rate of air or gas flow is reached, the vent valve automatically closes and blocks gas or air flow through the corresponding vent. When the differential pressure across the closed vent valve 84 drops below a predetermined value, the vent valve automatically opens to allow gas or air flow through the corresponding port. The vents 82 are so spaced along the recycle conduit 66 that the uppermost vent 82 is positioned a short distance below the top surface of the settled bed of solids in the lower portion of the recycle conduit when vacuum has been withdrawn from the recycle conduit. When vacuum is reapplied to the recycle conduit by the blower 60, air is drawn through all the vents 82 and open valves 84 to facilitate fluidization of the settle bed of solids in the conduit 66. As the upper portion of the solids bed is fluidized in the conduit 66, the air or gas flow through the uppermost vent 82 and corresponding valve 84 increases until the flow rate reaches the predetermined threshold value resulting in the closure of the uppermost valve 84. This procedure continues with each next uppermost vent 82 and valve 84 until the entire bed is fluidized and recycle flow of solids upwardly through the recycle conduit 66 from the outlet conduit 42 is achieved.

It is presently preferred to employ a baffle 86 disposed within the vessel 10 between the upper region and the lower region so as to provide blockage of a substantial amount of communication between the upper and lower regions. The baffle 86 suitably comprises a generally conically shaped portion 88 with the apex 90 thereof pointed upwardly. It will be understood that the use of the baffle 86 is optional.

The vessel 10 can be filled with particulate materials or solids to be blended by means of a conduit 92 which communicates with the solids inlet 18. A conduit 94 is connected to the lower end of the outlet conduit 42 below the solids flow control valve 44 to withdraw blended particulate materials or solids therefrom. The conduit 94 communicates with a suitable conveyor 96 by means of which the blended particulate materials or solids can be conveyed away for further use or processing as desired. Suitable structures for use as the conveyor 96 include closed and open mechanical conveyors as well as conduits connected to a source of pneumatic pressure or vacuum to convey the particulate materials or solids therealong to further use or processing.

In operation, the apparatus of the present invention is preferably employed to blend a large quantity or batch of particulate materials or solids in a single pass through the apparatus. In so operating the apparatus, the valves 44 and 58 are initially in their respective first conditions, e.g. non-rotating conditions, blocking particulate material or solids flow therepast. The solids flow control valve 70 is initially positioned to completely block particulate material flow therepast. Particulate materials or solids are then introduced into the vessel 10 through the conduit 92 and solids inlet 18.

During the filling of the vessel 10 with the particulate materials, the valve 58 is placed in its second or rotating condition and the blower 60 is actuated applying a vacuum to the solids hopper 50 and recycle conduit 66 thereby withdrawing a portion of the thus introduced solids from the outlet conduit 42 through the recycle conduit 66 and into the solids hopper 50. If a weight-biased or spring-biased flapper valve is employed as the solids flow control valve 58, the valve 58 is initially biased into its first condition blocking flow of gas and solids through the copper conduit 56. Although any desired portion of the particulate materials can be recycled to the solids hopper 50, generally a portion in the range from about 10 to about 50 percent or more of the total batch of particulate materials to be loaded into the vessel 10 will be recycled to the solids hopper 50. After the total quantity of particulate materials or solids to be blended has been fed into the vessel 10, the blower 60 is stopped and the particulate materials in the recycle conduit 66 are allowed to settle therein under the influence of gravity. The blower 60 can also be stopped at any time during the filling of the vessel 10 and the particulate materials allowed to settle. At these times the sample valve 76 can be opened and a sample of the recycled particulate materials or solids can be drained from the recycle conduit 66 through the conduit 78 into the sample container 80 for analysis. The valve 76 is then placed back in its initial condition blocking passage of solids therethrough. Samples removed from the recycle conduit 66 are extremely representative of the blend withdrawn from the outlet conduit 42 since the particulate materials are intimately mixed within the conduit 66 due to the fluidization of the solids under the influence of the vacuum applied thereto.

After the blower 60 has been stopped and any desired samples have been withdrawn from the recycle conduit 66, the valve 58 is maintained in its second condition, e.g. rotating condition, allowing the solids contained within the solids hopper 50 to flow downwardly by gravity through the valve 58, hopper conduit 56 and solids inlet 18 into the vessel 10, thus placing the apparatus in condition to pass the entire batch of particulate materials or solids therethrough in a blended condition. If a weight-biased or spring-biased flapper valve is employed as the solids flow control valve 58, the weight of the solids in the solids hopper overcomes the weight-bias or spring-bias in the absence of a vacuum applied to the interior of the solids hopper 50 by the blower 60 thus placing the flapper valve in its second or open condition allowing the solids contained within the solids hopper 50 to flow downwardly by gravity therethrough. When the solids have drained from the solids hopper through the flapper valve, the weight-bias or spring-bias of the flapper valve returns it to its first or closed condition.

When the vessel 10 is full and the recycle hopper 50 has been drained into the vessel 10, the solids flow control valve 44 is placed in its second condition, e.g. rotating condition and the solids flow control valve 70 is then placed in its second condition opening the outlet conduit 42 to obtain the desired drain rate therepast, allowing the passage of the particulate materials or solids downwardly through the blender apparatus and out through the outlet conduit 42 and valve 44 where the thus blended particulate materials or solids can be conveyed away via the conduit 94 and suitable conveyor apparatus 96 for further use or processing. The valve 44 should be of sufficient capacity and be capable of sufficient operating speed to prevent any buildup of solids between the valve 44 and the valve 70.

It is imperative that the recirculation system of the apparatus of the present invention not be employed while the solids flow control valve 70 is open and the particulate materials or solids are being drained from the system through the valve 44 because the recycle system would then be sampling only a portion of the particulate materials or solids being drained and would not recycle a uniform mixture of material from the blender. The recirculation or recycle system can be started before the vessel 10 is full and should preferably be started when filling of the vessel is initiated and continued for at least a short time after the blender is full to ensure that a good sample of the blender contents is obtained. If additional blending is needed, the recirculation can be continued for an additional amount of time.

During the recirculation or recycle, particulate materials or solids are drawn uniformly from the lower portion of the blender apparatus because the outlet conduit 42 is sized to be long enough and the solids flow control valve 70 is spaced far enough below the solids outlet 20, e.g., about two times the internal diameter of the outlet conduit 42, to produce uniform flow in the upper portion of the outlet conduit 42 even through the inlet at the lower end 68 of the recycle conduit 66 may be positioned slightly to one side of the vertical center line of the outlet conduit 42. Thus the flow of particulate materials or solids will stabilize flowing toward the lower end 68 of the recycle conduit 66 and will produce a uniform composition from all of the blender conduits 24, 26, 28, 30, 32 and 34 as well as the solids outlet 20 and will produce a good sample to be withdrawn via the sample valve 76 from the recycle conduit 66. The recycle apparatus will obtain uniform samples from any blender apparatus in which there is uniform solids flow downwardly within the outlet conduit 42 at the bottom opening of the solids outlet 20. Under such conditions the solids outlet 20 and the annular space between the solids outlet 20 and the outlet conduit 42 operate full of particulate materials or solids.

From the foregoing detailed description, it will be seen that the apparatus and method of its use described and illustrated herein eminently achieves the objects of the present invention. The process of the present invention, which is characterized by the recycle of a portion of the solids from the outlet conduit 42 to the solids inlet 18 of the vessel 10 while the vessel 10 is being filled with solids, improves the blending of such solids by (1) diluting the unblended solids being introduced into the vessel 10 with recycled partly blended solids, and (2) removing solids from the bottom of the blender (where such solids are most difficult to blend) during the filling operation and replacing the thus removed solids with partly blended solids from higher in the blender. Changes may be made in the combination and arrangement of parts or elements as heretofore set forth in the specification and shown in the drawing without departing from the spirit and scope of the invention as defined in and limited only by the following claims.

I claim:

1. Solids blending apparatus comprising:

a vessel having an upper region and a lower region and having solids inlet means communicating with the interior of the upper region thereof and solids outlet means communicating with the interior of the lower region thereof, the lower region of said vessel being defined by a downwardly converging generally frustoconically shaped bottom wall;

conduit means communicating between at least one location in the interior of the upper region of said vessel and said solids outlet means at a first location below said bottom wall for conducting solids from the upper region of said vessel to said solids outlet means;

first solids flow control means disposed in said solids outlet means at a second location below said first location for blocking flow of solids downwardly through said solids outlet means when said first solids flow control means is in a first condition, and, alternately, for allowing flow of blended solids downwardly therepast through said solids outlet means when said first solids flow control means is in a second condition;

solids hopper means disposed above said vessel for receiving solids therein, said solids hopper means having upper and lower end portions;

hopper conduit means communicating between the lower end portion of said solids hopper means and the interior of the upper region of said vessel for conducting solids from said solids hopper means into the upper region of said vessel;

second solids flow control means operatively related to said hopper conduit means for blocking flow of gas and solids through said hopper conduit means, and, alternately, for allowing flow of solids therepast through said hopper conduit means;

vacuum means in fluid flow communication with the interior of said solids hopper means for applying a vacuum to the interior of said solids hopper means; and solids recycle conduit means communicating between said solids outlet means, at a third location intermediate said first and second locations, and the interior of said solids hopper means for conducting solids from said solids outlet means to the interior of said solids hopper means in response to the vacuum applied to the interior of said solids hopper means by said vacuum means.

2. Solids blending apparatus in accordance with claim 1 characterized further to include means communicating with said solids recycle conduit means for withdrawing a sample of solids from said solids recycle conduit means.

3. Solids blending apparatus in accordance with claim 1 characterized further to include means for separating solids within said solids hopper means from said vacuum means.

4. Solids blending apparatus in accordance with claim 1 characterized further to include vent means communicating between the atmosphere and the interior of said solids outlet means below said second location.

5. Solids blending apparatus in accordance with claim 4 characterized further to include third solids flow control means disposed in said solids outlet means below said vent means for controlling the flow of solids therepast.

6. Solids blending apparatus in accordance with claim 5 characterized further to include second vent means communicating between the interior of said solids outlet means above said third solids flow control means and the interior of said third solids flow control means for maintaining the interior of said third solids flow control means at atmospheric pressure.

7. Solids blending apparatus in accordance with claim 1 characterized further to include recycle vent means communicating between the interior of said solids recycle conduit means and atmosphere at at least one location along the length of said solids recycle conduit means for admitting gas therethrough to facilitate fluidizing solids in said solids recycle conduit means in response to the vacuum applied thereto by said vacuum means.

8. Solids blending apparatus in accordance with claim 6 wherein said recycle vent means includes vent valve means for controlling the flow of gas admitted through said recycle vent means.

9. Solids blending apparatus in accordance with claim 1 characterized further to include conveyor means communicating with said solids outlet means below said first solids flow control means for conveying blended solids therefrom.

10. Solids blending apparatus in accordance with claim 1 characterized further to include:

means communicating with said solids recycle conduit means for withdrawing a sample of solids from said solids recycle conduit means;

vent means communicating between the atmosphere and the interior of said solids outlet means below said second location;

third solids flow control means disposed in said solids outlet means below said vent means for controlling the flow of solids therepast;

recycle vent means communicating between the interior of said solids recycle conduit means and atmosphere at a least one location along the length of said solids recycle conduit means for admitting gas therethrough to facilitate fluidizing solids in said solids recycle conduit means in response to the vacuum applied thereto by said vacuum means; and second vent means communicating between the interior of said solids outlet means above said third solids flow control means and the interior of said third solids flow control means for maintaining the interior of said third solids flow control means at atmospheric pressure.

11. A method of blending solids comprising:

(a) introducing solids to be blended into the vessel of said apparatus as defined in claim 1 through said solids inlet means of said apparatus with said first solids flow control means of said apparatus in said first condition;

(b) simultaneously with at least a portion of the performance of step (a), recycling a portion of said thus introduced solids from said solids outlet means into said solids hopper means of said apparatus via said solids recycle conduit means of said apparatus with said second solids flow control means of said apparatus in said first condition threreof;

(c) terminating step (b) when said solids hopper means is filled to a predetermined level with said thus recycled solids;

(d) terminating step (a) when said vessel is filled to a predetermined level with said solids to be blended;

(e) introducing said thus recycled solids from said solids hopper means into said vessel via said hopper conduit means of said apparatus and said second solids flow control means with said second solids flow control means in said second condition thereof; and (f) draining said thus filled vessel of said solids via said conduit means, said solids outlet means and said first solids flow control means when said first solids flow control means is in said second condition to provide blended solids.

12. A method of blending solids in accordance with claim 11 wherein step (e) is performed subsequent to the completion of step (c).

13. A method of blending solids in accordance with claim 11 wherein step (e) is performed subsequent to the completion of steps (c) and (d).

14. A method of blending solids in accordance with claim 11 characterized further to include withdrawing a sample quantity of said recycled solids from said apparatus.

15. A method of blending solids in accordance with claim 11 characterized further to include withdrawing a sample quantity of said recycled solids from said solids recycle conduit means.

16. A method of blending solids in accordance with claim 11 wherein step (b) is terminated prior to the termination of step (a).

17. A method of blending solids in accordance with claim 11 wherein step (b) is terminated subsequent to the termination of step (a).

18. A method of blending solids in accordance with claim 11 characterized further to include temporarily terminating step (b) at least once and withdrawing a sample quantity of said recycled solids from said solids recycle conduit means and thereafter continuing step (b) prior to step (c).

19. A method of blending solids in accordance with claim 18 characterized further to include admitting gas through recycle vent means communicating between the interior of said solids recycle conduit means and atmosphere at at least one location along the length of said solids recycle conduit means when continuing step (b) prior to step (c) to facilitate fluidizing solids in said solids recycle conduit means.

20. A method of blending solids in accordance with claim 19 wherein step (b) is performed by applying a vacuum to the interior of said solids hopper means by said vacuum means.

21. A method of blending solids in accordance with claim 11 wherein at least a portion of step (e) is performed simultaneously with the performance of step (b).

* * * * *